US007131912B1

(12) United States Patent
Knuth

(10) Patent No.: US 7,131,912 B1
(45) Date of Patent: Nov. 7, 2006

(54) GOLF CLUB HEAD

(75) Inventor: Dean Leslie Knuth, Bonita, CA (US)

(73) Assignee: Dean L. Knuth, Bonita, CA (US)

( * ) Notice: Subject to any disclaimer, the term of this patent is extended or adjusted under 35 U.S.C. 154(b) by 0 days.

(21) Appl. No.: 10/442,264

(22) Filed: May 21, 2003

Related U.S. Application Data

(63) Continuation-in-part of application No. 10/188,808, filed on Jul. 5, 2002, now Pat. No. 6,659,885, which is a continuation-in-part of application No. 10/062,234, filed on Feb. 1, 2002, now Pat. No. 6,659,884.

(51) Int. Cl.
*A63B 53/04* (2006.01)

(52) U.S. Cl. ..... 473/342; 473/329; 473/349; 473/350

(58) Field of Classification Search ..... 473/349, 473/345, 324, 342, 290, 291, 329; 148/325, 148/328, 326, 12 R
See application file for complete search history.

(56) References Cited

U.S. PATENT DOCUMENTS

| | | | | |
|---|---|---|---|---|
| D93,862 | S | 11/1934 | Barnhart | |
| 3,825,991 | A * | 7/1974 | Cornell | 29/412 |
| 4,314,863 | A * | 2/1982 | McCormick | 420/61 |
| 4,432,549 | A | 2/1984 | Zebelean | |
| 4,750,947 | A * | 6/1988 | Yoshiwara et al. | 148/512 |
| 5,024,437 | A | 6/1991 | Anderson | |
| 5,028,049 | A | 7/1991 | McKeighen | |
| 5,089,067 | A * | 2/1992 | Schumacher | 148/325 |
| 5,167,733 | A * | 12/1992 | Hsieh | 148/522 |
| 5,232,224 | A * | 8/1993 | Zeider | 473/345 |
| 5,255,918 | A | 10/1993 | Anderson et al. | |
| 5,261,663 | A | 11/1993 | Anderson | |
| 5,261,664 | A | 11/1993 | Anderson | |
| 5,318,300 | A | 6/1994 | Schmidt et al. | |
| 5,344,140 | A | 9/1994 | Anderson | |
| 5,362,047 | A | 11/1994 | Shaw et al. | |
| 5,366,223 | A | 11/1994 | Werner et al. | |
| 5,464,216 | A * | 11/1995 | Hoshi et al. | 473/349 |
| 5,547,188 | A | 8/1996 | Dumontier et al. | |
| 5,569,337 | A * | 10/1996 | Yoshida et al. | 148/325 |
| 5,611,741 | A | 3/1997 | Schmidt et al. | |
| 5,624,331 | A | 4/1997 | Lo et al. | |
| 5,720,673 | A | 2/1998 | Anderson | |

(Continued)

FOREIGN PATENT DOCUMENTS

RU 2170129 C1 * 7/2001

OTHER PUBLICATIONS

Bannikov. V . V., Golf Club Head, Jul. 10, 2001, pp. 1-10 (Translation of RU 2170129C).*

(Continued)

*Primary Examiner*—Glenn Caldarola
*Assistant Examiner*—Tom P. Duong
(74) *Attorney, Agent, or Firm*—Rothwell, Figg, Ernst & Manbeck. P.C.

(57) ABSTRACT

The present invention, in one embodiment, provides a method for making a wood-type golf club head. The method includes the steps of: forming a face portion of the golf club head from a piece of sheet metal consisting essentially of a titanium alloy; and after forming the face portion, attaching the formed face portion to a crown and a sole of the golf club head. The step of forming the face portion includes pressing the piece of sheet metal into a die at about 70 tons psi.

17 Claims, 4 Drawing Sheets

U.S. PATENT DOCUMENTS 5,830,084 A * 11/1998 Kosmatka ..... 473/349
5,896,642 A * 4/1999 Peker et al. ..... 29/522.1
5,954,596 A 9/1999 Noble et al.
5,971,868 A 10/1999 Kosmatka
5,989,134 A 11/1999 Antonious
6,021,840 A * 2/2000 Colvin ..... 164/113
6,027,416 A 2/2000 Schmidt et al.
6,070,643 A * 6/2000 Colvin ..... 164/61
6,074,308 A 6/2000 Domas
6,277,033 B1 8/2001 Krumme et al.
6,319,149 B1 11/2001 Lee
6,319,150 B1 11/2001 Werner et al.
6,368,234 B1 * 4/2002 Galloway ..... 473/349
6,435,981 B1 8/2002 Naruo et al.
6,966,848 B1 * 11/2005 Kusumoto ..... 473/342
2003/0162607 A1 8/2003 Tsunoda et al.
2003/0181256 A1 9/2003 Kosmatka

OTHER PUBLICATIONS

Russian Titanium Alloys, http://www.titaniummetal.net/specifications/russian.html. (2 pages). (Downloaded on Jun. 23, 2004).

* cited by examiner

GOLF CLUB HEAD

This application is a continuation-in-part of U.S. patent application Ser. No. 10/188,808, filed Jul. 5, 2002, now U.S. Pat. No. 6,659,885, which is a continuation-in-part of U.S. patent application Ser. No. 10/062,234, Filed Feb. 1, 2002, U.S. Pat. No. 6,659,884. The contents of the above identified applications are incorporated herein by reference.

BACKGROUND OF THE INVENTION

1. Field of Invention

The present invention relates, generally, to a golf club head and, more specifically, to a golf club head with a face made from a titanium alloy.

2. Discussion of the Background

When a golf club strikes a golf ball at rest, the ball is propelled at high speed from the tee to the landing area. Thus, the kinetic energy of the moving club head is converted to kinetic energy in the moving golf ball. The golf ball is only in contact with the face of the golf club for a few millionths of a second during impact and the distance achieved by the golf ball is a result of the combination of the initial velocity of the ball after impact, the launch angle, and the spin of the ball. Generally, however, the greater the velocity of the ball after impact, the farther the ball will travel.

The mass of the club head and the velocity at impact combine to determine the initial velocity of the golf ball after impact. However, not all of the energy transferred to the ball is converted to kinetic energy and manifested as velocity. Some of the energy manifests as heat in the ball. Much of the kinetic energy lost as heat is related to the viscoelastic response of the ball during deformation.

The present invention is, in part, a result of the discovery that a golf club face that deforms in preference to the ball will, unless it is a lossy viscoelastomer, generally have a smaller hysteresis loop on deformation and, therefore, result in less energy loss. In addition, it has been found that it is preferable that the face of the club head deform more than the remainder of the club head body. Thus, controlling deformation of the golf club head in preference to deformation of the golf ball will result in the golf ball traveling farther.

Generally, a golf club comprises a shaft portion, a head portion, and a grip portion. The part of the golf club head portion that comprises the hitting surface is referred to as the golf club "face". Generally, a golf club face abuts or is adjacent to both a top wall (or crown) of the club head and a bottom wall (or sole) of the club head.

Most "woods", such as the driver and the fairway woods, are in the form of a hollow shell (or perhaps filled with foam), usually of metal. Because only the best and strongest golfers can effectively swing a driver head that weighs more than 220 grams, the maximum weight of the club head is essentially a design constraint of the club head. Further, when the front side of the face of the golf club head strikes a golf ball, extremely large impact forces are produced potentially causing cracking and/or material failure. Thus, the golf club face portion must be structurally adequate to withstand large repeated forces, such as those associated with ball impact. In addition, a large club head face is highly desirable because it strongly reduces the percentage of errant hits.

Thus, there are contrasting design considerations when designing a golf club head—the desirability of a light club head, but with a large club face and a club head that is durable enough to withstand repeated striking of the ball. One method of increasing the durability of the club head is to add additional material (e.g., steel or titanium) to thicken the club face or to add ribs to the club face. However, the designer cannot simply add additional material to strengthen the face indiscriminately because doing so also increases the overall weight of the club head, which is undesirable.

Prior golf club heads typically had relatively thick faces, which would deform only slightly at impact thereby causing the golf ball to deform, which created a significant loss of kinetic energy through conversion of heat in the ball.

Thus, there is a need for a new golf club head with a club face structure providing enhanced deformation for improving club performance, and that has structural integrity, thereby reducing cracking and material failure, without otherwise adversely affecting club performance, look, and feel; and with limited affect on club head weight.

SUMMARY OF THE INVENTION

The primary object of the present invention is to overcome the deficiencies of the prior art described above by providing a golf club head with enhanced deformation for hitting a golf ball farther.

The present invention accomplishes this object by providing, in one embodiment, a golf club head having a face made from titanium alloy BT-22.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following description, for purposes of explanation and not limitation, specific details are set forth, such as particular materials, shapes, methods of manufacture, casting processes, etc. in order to provide a thorough understanding of the present invention. However, it will be apparent to one skilled in the art that the present invention may be practiced in other embodiments that depart from these specific details. Detailed descriptions of well-known casting processes, materials, golf club shapes, methods of manufacturing, devices, components, shafts, uses, techniques, and associated technologies, are omitted so as not to obscure the description of the present invention.

Figure 1:
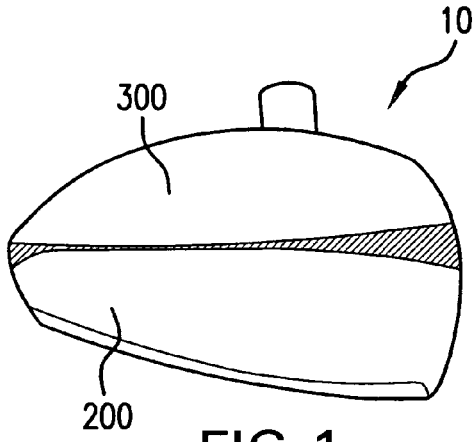
FIG. 1 is a front side view of an example embodiment of a club head of the present invention.
Figure 2:
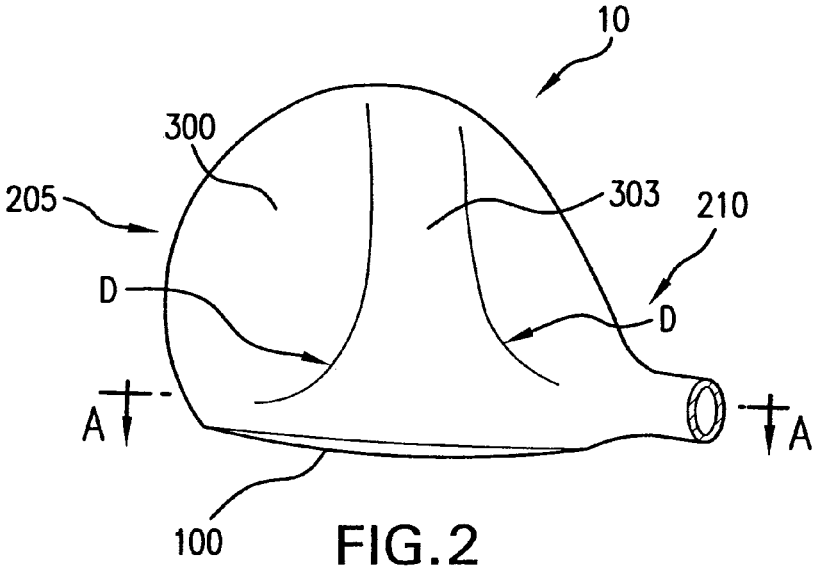
FIG. 2 is a top view of an example embodiment of a club head of the present invention.
Figure 3:
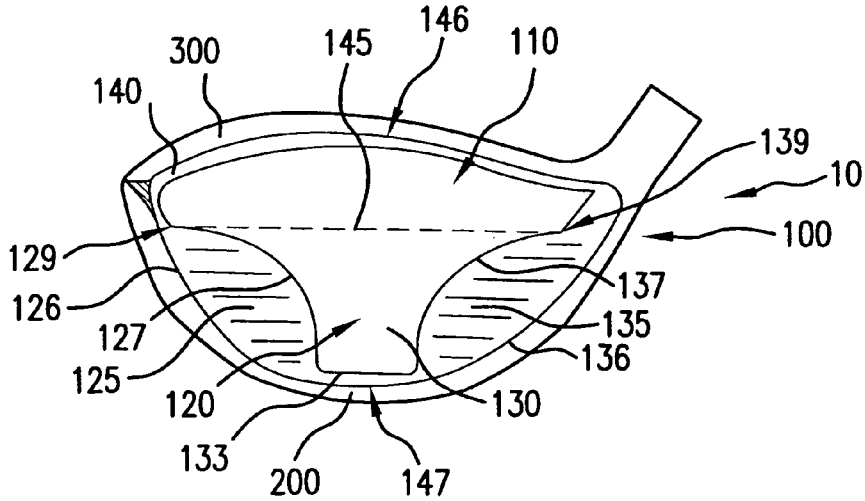
FIG. 3 is a right side view of a club head of an example embodiment of the present invention.

As shown in FIGS. 1–5, the present invention includes a sole 200, a crown 300, and a face portion 100, which together form club head 10. Referring specifically to FIG. 3, in the example embodiment of the present invention, the face portion 100 includes an upper portion 110, which is above the dashed line 145 shown in FIG. 3, and a lower portion 120, which is below the dashed line 145 shown in FIG. 3. The horizontal and vertical lines of FIG. 3 identify portions of the face portion 100 that have substantially the same thicknesses.

The lower portion 120 includes a lower toe portion 125 that is located towards the toe of the club head, a lower heel portion 135 that is positioned towards the heel of the club head, and a center portion 130 between the lower toe portion 125 and lower heel portion 135. The lower toe portion 125, which is generally oval in shape or more particularly shaped in two inverted ellipses, or approximately like a football, includes an outer edge 126 that is towards the sole 200 and the toe 205 of the club head and an inner edge 127 that is adjacent the center portion 130. Likewise, the lower heel portion 135, which is generally oval in shape, or more particularly shaped like a football, includes an outer edge 136 that is towards the sole 200 and heel 210 of the club head and an inner edge 137 that is adjacent the center portion 130.

The outer edge 126 of the lower toe portion 125 is slightly curved and is adapted to mate with the front edge of sole 200. The inner edge 127 of the lower toe portion 125 is curved and in particular is generally parabolic in shape in this example embodiment. In addition, the inner edge 127 extends from the upper portion 110 near the toe 205 to about one third of the distance to the heel 210 from the toe 205. The radius of curvature of the inner edge 127 of the lower toe portion 125 is 0.75 inches as the inner edge 127 approaches the center portion 130.

The outer edge 136 of the lower heel portion 135 is slightly curved and is adapted to mate with the front edge of sole 200. The inner edge 137 of the lower heel portion 135 is curved and in particular is generally parabolic in shape in this example embodiment. In addition, the inner edge 137 extends from the upper portion 110 near the heel 210 to about one third of the distance to the toe 205 from the heel 210. The radius of curvature of the inner edge 137 of the lower heel portion 135 is 0.75 inches as the inner edge 137 approaches the center portion 130.

The center portion 130 of lower portion 120 includes a heel side edge which coincides with inner edge 137, a bottom edge 133, a toe side edge which coincides with inner edge 127, and a top edge indicated by dashed line 145. The bottom edge 133 of the center portion is substantially straight and is 0.079 inches in length. The top edge of the center portion 130 is integral with the upper portion 110 and the vertical distance from the bottom edge 133 of the center portion 130 to the top center edge 146 of the upper portion 110 is 1.75 inches. As discussed above, the parabolic shape of the edges provide increased strength, which greatly enhances the ability of the club face to deform more than the ball while maintaining structural integrity.

As is evident in the figures, the upper portion 110 extends substantially the entire length of the face 100 (i.e., substantially the entire distance from the heel to the toe). In addition, the upper portion 110 in this example embodiment extends from near the top center 146 edge of the face 100 about one fourth to one half of the distance from the top center edge 146 to the bottom center edge 147 as indicated by the dashed line 145 in FIG. 3. In this embodiment, the dashed line 145 indicates the separation of the upper 110 and lower portions 120 also coincides with the upper ends 129 and 139 of inner edges 127 and 137, respectively. In alternate embodiments of the present invention, the upper portion 110 could extend a longer or shorter distance down the face 100. In this embodiment, the upper portion 110 extends nearly, but not quite all the way, to the very top edge 146. The radius of curvature of the upper end 129 of the upper portion 110 near the toe is 1.675 inches.

Substantially all of the upper portion 110 and the lower center portion 130 have substantially the same thicknesses. In this example embodiment, the thickness of lower center portion 130 and upper portion 110 is in the range of 0.070 inches to 0.095 inches and is preferably from 0.080 inches to 0.085 inches. The lower toe portion 125 and the lower heel portion 135 are also substantially the same thickness, which is in the range of 0.055 to 0.065 inches and preferably 0.0575 to 0.0625 inches and most preferably approximately 0.060 inches.

Figure 5:
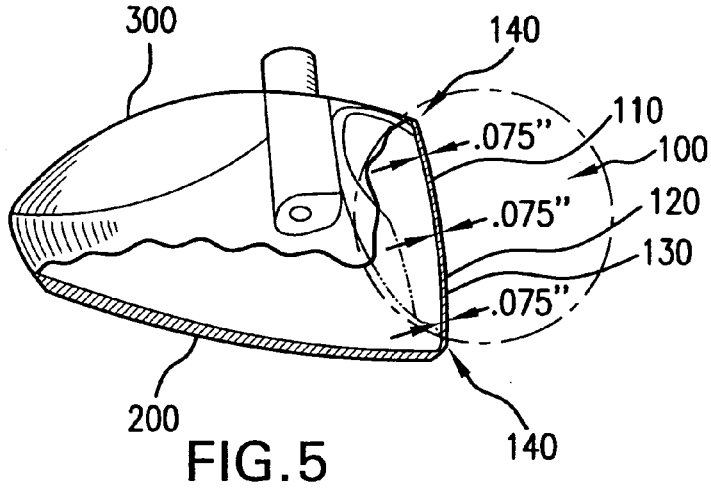
FIG. 5 is a cross-sectional view of an example embodiment of a club head of the present invention along line B—B of FIG. 4.
Figure 6:
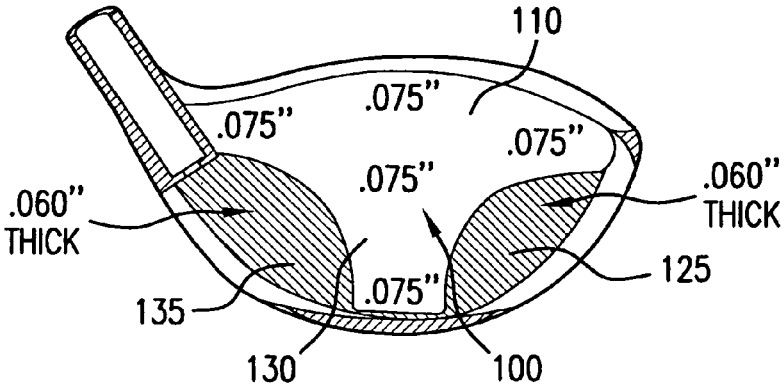
FIG. 6 is a cross-sectional view of an example embodiment of a club head of the present invention along line A—A of FIG. 2.

As shown in FIGS. 3 and 5, in this embodiment a channel 140 is disposed around the peripheral of the face 100. The channel 140 has a curved surface on the inside of the club head 10 (i.e., the back side of the face 100). In addition, the channel 140 is thinner than the other portions of the face 100, thereby aiding in the deformation of the club face 100. In this example embodiment, the channel 140 is approximately 0.005 inches thinner than the thickness of the adjacent face portion 100. The channel 140 is 0.003 inches wide and is preferably in the range of 0.0525 inches to 0.0575 inches and more preferably approximately 0.055 inches thick at its thinnest point. Channels in other embodiments of the present invention may extend only partially around the face, or not at all, and may be other thicknesses.

The present invention also includes the removal of conventional score lines in the center of the face where the face is thickest, in a shape that profiles the parabolic shape. More specifically, the face portion 100 includes a portion that has no score lines that is shaped substantially as an inverted triangle (i.e., base at the top) with a truncated apex (i.e., connected points 129, 139 with the respective corners of the lower center portion 130 as shown in FIG. 3). The score lines on the outside of the face portion 100 end outside the internal parabolic shaped inner edges 137, 127 of the lower heel portion 135 and lower toe portion 125. The effect is to further strengthen the hitting area of the face and to further improve durability. Alternate embodiments of the present invention could include score lines over part or all of the face.

Figure 4:
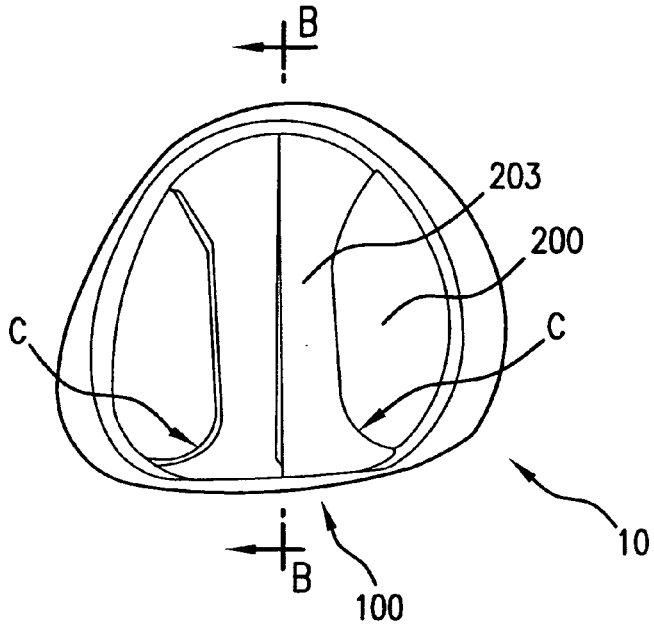
FIG. 4 is a bottom view of an example embodiment of a club head of the present invention.

As shown in FIG. 4, the sole 200 of the club head 10 includes a ridge across the sole 200 that produces a center rail 203 from back to front with a parabolic rise towards the face 100 of the club. The parabolic rise (indicated by the arrows labeled C in FIG. 4) on the sole 200 provides additional lateral strength to the club head, without adding thickness to the sole 200 while still permitting the sole 200 to bend at impact with a golf ball on the face. The center rail 203 also aids the golfer when setting up to strike the ball and assists the golfer in getting the ball airborne. Thus, the center rail 203 reduces friction should the club hit the ground while swinging so that the club may be used as a fairway wood. The wall thickness of the sole 200 is 0.035 inches and the radius of curvature of the parabolic rise is 0.5 inches. The center rail is approximately 1.09 inches wide at its narrowest point.

As shown in FIG. 2, the crown 300 includes a center ridge 303 across the crown 300 from back to front with a parabolic rise towards the face 100 of the club. The parabolic rise (indicated by the arrows labeled D in FIG. 2) on the crown 300 provides additional lateral strength to the club head, without adding thickness to the crown 300 while still permitting the crown 300 to bend at impact. The center ridge 303 also provides a visual aid to the golfer when setting up to strike the ball. The wall thickness of the crown 300 is 0.035 inches and the radius of curvature of the parabolic rise is 1.150 inches. The center ridge 303 is approximately 0.7 inches wide at the rear of the club and is 3.4 inches wide towards the front of the club head.

As discussed above, the parabolic rise in the sole 200 and crown 300 provides increased strength, which greatly enhances the ability of the club face to deform more than the ball and to maintain structural integrity.

It is also preferable that the wall thickness of the sole 200 and crown 300 vary, being slightly thicker toward the heel. The varying thickness moves the center of gravity toward the heel, which improves performance by building in a hook bias thereby assisting the golfer in pronating the club head as the club approaches the ball during the swing. In this example embodiment, the crown and sole vary from about 0.035 inches at the toe to about 0.040 inches at the heel.

In one method of making the golf club head 10, the crown is cast with the face and a small lip that extends rearward approximately 0.25 inches from the face. The sole is then welded to the crown and to the lip extending from the face as shown by the jagged line of FIG. 5. By this manufacturing procedure, the thickness of the connection of the face to the crown can be accurately controlled. In this embodiment, the club head is formed of steel, but other embodiments may use alternative materials such as titanium, Teflon, or like materials, and different portions of the club head may be made of different materials. The face of the steel club head may be polished (shiny) so that the impact of the ball with the club head results in a mark where the ball impacted the club head face. Thus, the club head face provides feedback to the golfer regarding where on the club face the golfer is striking the ball. The polished nature of the club face allows the golfer to repeatedly get the feedback by periodically wiping the club face clean.

In the present example embodiment, the shaft is attached to the club head 10 in any conventional fashion. The shaft may be any shaft suitable for the golfer such as Penley® or Graphite Design® shafts. The hosel neck protrudes 0.500 inch out of the heel end of the crown. The total hosel depth is 1.500 inch from the top of the hosel to the seat within the club head, so the hosel is one inch into the club head. The total distance from the tip of the hosel to the sole is 3.150 inch.

The club of the above example is USGA compliant with a club head that is 280 cubic centimeters and weighs 200 g 4 g. The weight of the sole plate is 46 g 4 g. Tables 1 and 2 below provide a number of parameters for golf clubs having 9.5 and 11 degree lofts, respectively.

TABLE 1

| | RH 9.5 | RH 11 |
|---|---|---|
| LOFT ANGLE | 9.5 | 11.0 |
| LIE ANGLE | 55.0 | 55.0 |
| FACE ANGLE | 1.0 close | 1.0 close |
| BULGE RADIUS | 10" R inch | 10" R inch |
| ROLL RADIUS | 9" R inch | 7" R inch |
| BOUNCE METRIC | 1 | 1 |
| FRONT TO BACK | 20" R inch | 20" R inch |
| HEEL TO TOE | 6" R inch | 6" R inch |

TABLE 2

| | RH 9.5 | RH 11 |
|---|---|---|
| INSIDE | 0.348 | 0.348 |
| DIAMETER OUTSIDE | 0.490 | 0.490 |
| DIAMETER HOSEL DEPTH | 1.500 | 1.500 |
| CHAMFER SIZE | .032 R<br>.080 Depth | .032 R<br>.080 Depth |
| HOSEL PAINT TAPE LINE | 0.500 | 0.500 |
| BOTTOM HOSEL TRUE HOLE DIAM. | 0.250 | 0.250 |
| WALL THICKNESS | 0.050 | 0.050 |

The outside diameter of the hosel is 0.500 inch and the inside diameter is 0.348 inch.

In a preferred embodiment of making the golf club head 10, the crown 300 and sole 200 are cast as one seamless and joined piece to form a cast body with a face opening that is only two millimeters larger than a precision formed face portion 100. The face portion 100 is then attached onto the cast body by, for example, welding or the like. The face portion 100 may be polished after welding and then the body may be painted. Next, a shaft may be fitted and gripped.

According to one embodiment, a method of making the face portion 100 includes forming the face portion from sheet metal (e.g., steel, titanium, titanium alloy, etc. sheet metal) formulated to provide very high strength and durability. In one embodiment the thickness of the sheet metal is about 0.075 inches and 275 steel, which is stronger than 17-5 stainless steel, may be used. A face portion formed from 275 steel can be manufactured with extreme accuracy and repeatability and will not lose durability over time.

In one embodiment, the face portion may be made from or include a material having the following properties: ultimate strength (Mpa) of about 1100–1250; yield strength (Mpa) of about 1000; elongation (%) of about 10; stress, time and temperature to produce 0.2% elongation (creep) of about 320 Mpa/100 hours/400 degrees centigrade; hardness (brinell) of about 285; beta transus (C) of about 840–880; density (g/cc) of about 4.6; modulus of elasticity (tension Gpa) of about 110; and specific heat (W/m*K) at room temperature of about 8.32. One material that has these or many of these properties is a Russian titanium alloy referred to herein as "BT-22." In one embodiment, BT-22 preferably includes or consists essentially of about 4.4 to 5.7 percent weight aluminum, 4.0 to 5.5 percent weight molybdenum, 4.0 to 5.5 percent weight vanadium, 0.5 to 1.5 percent weight chromium and 0.5 to 1.5 percent weight iron and the remainder being substantially titanium. Other formulations of BT-22 are contemplated. BT-22 preferably has a maximum of 0.1 percent weight carbon, 0.15 percent weight silicon, 0.18 percent weight oxygen, 0.05 percent weight nitrogen and 0.015 percent weight hydrogen. A face plate made from sheet metal consisting of or essentially of BT-22 produces excellent results. BT-22 can be obtained from Cronos Ltd., Moscow, Russia.

Based on the specified size and curvature of the desired face portion 100, the sheet metal is laser cut, thereby forming a laser cut blank. The laser cut blank is then precision machined to provide the variable thickness in the face design as described herein. The scorelines (e.g., grooves), if any, may be engraved onto the outside of the laser cut blank using, for example, 70,000 RPM high speed spindles. The machined blank is then pressed into a die at, for example, 70 tons psi, to form the desired face portion 100. The pressure applied to the machined blank forms the blank into a precise face portion with exact bulge and roll characteristics according to specifications described herein. The face portion 100 is then heat treated at high temperature to raise the Rockwell Hardness of the face portion to 45 or higher. Once completed the process yields a very high strength precision formed face portion.

Figure 7:
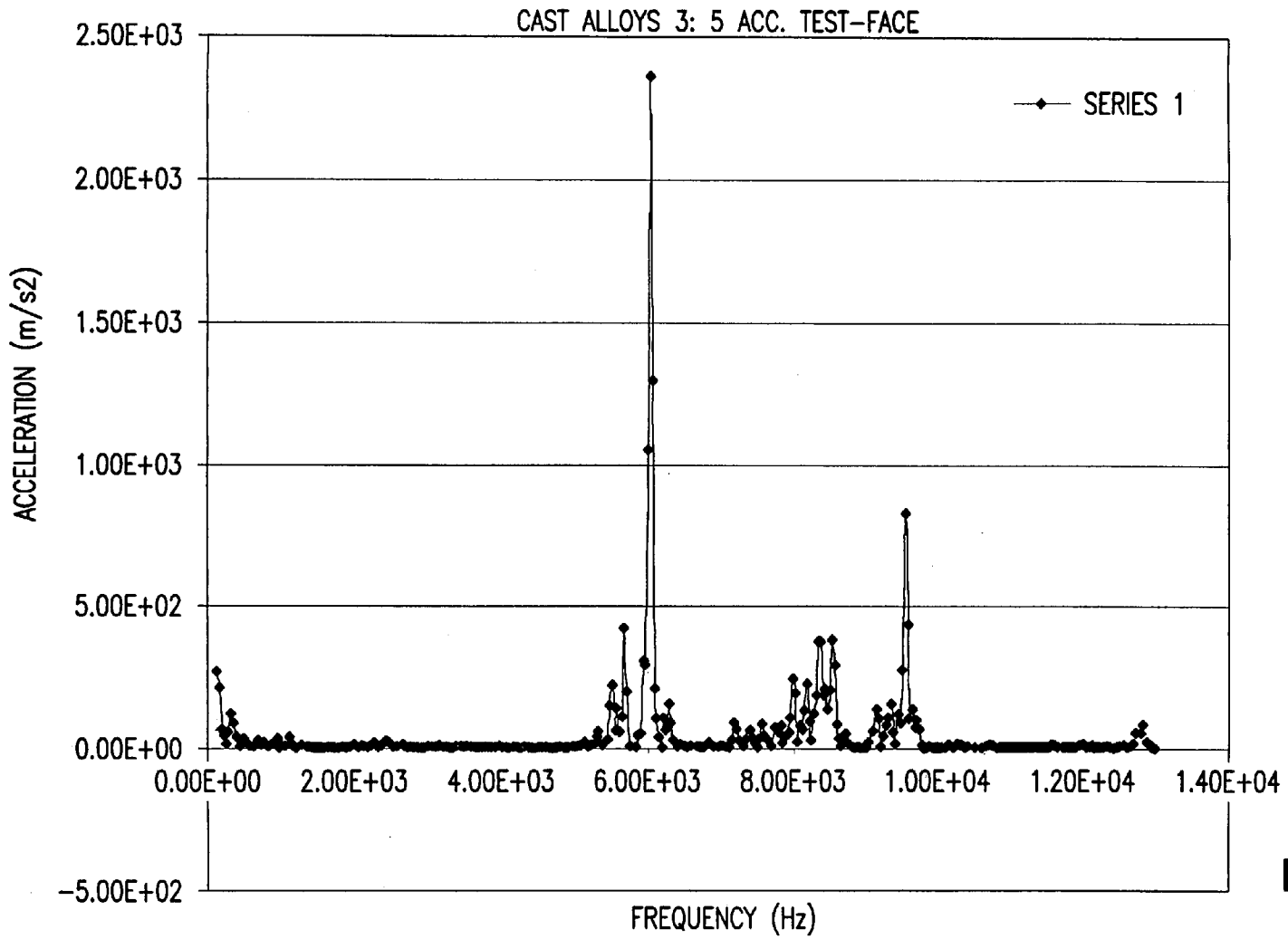
FIG. 7 depicts the vibrational response of an example embodiment of a golf club according to the present invention striking a golf ball.

FIG. 7 depicts the vibrational response of a golf club embodying an embodiment of the present invention striking a golf ball, which relates to the club's fundamental frequency. The resultant golf club provides a higher fundamental frequency than existing club heads. The combination of high fundamental frequency and greater deformation of the club head reduces the energy lost as heat in the golf ball (and club) at impact.

The club heads described herein are suitable for use as a driver or wood. The size, weight, and angle on the face of the club head of the present invention may vary depending on the use of the club head in, for example, a driver, 3-wood, 5-wood, etc. For example, the club head of the present invention used in a 3-wood is about ⅔ the size of the club head used in a driver, and the angle on the face is about 13 degrees. The angle on the face of the club head of the present invention used in, for example, a 5-wood is about 17 degrees. The volume of a club head of the present invention used in a driver may be, for example, about 280 cc, or may be about 400 cc or 460 cc in an oversized or jumbo type driver made of titanium, for example.

While the above example embodiment includes a center portion 130 that has two curved sides that abut lower heel portion 135 and lower toe portion 125, in an alternative embodiment the sides could be straight so that inner edges 137 and 127 are straight. In addition, while the transition from the thickness of the center portion to the thickness of the lower toe portion 125 and lower heel portion 135 (which define edges 127 and 137, respectively) is abrupt in the above example embodiments, in an alternate embodiment the transition could be more gradual (for example, transitioning over a half inch, three eighths of an inch, quarter inch, eighth inch, or sixteenth of an inch).

Figure 8A:
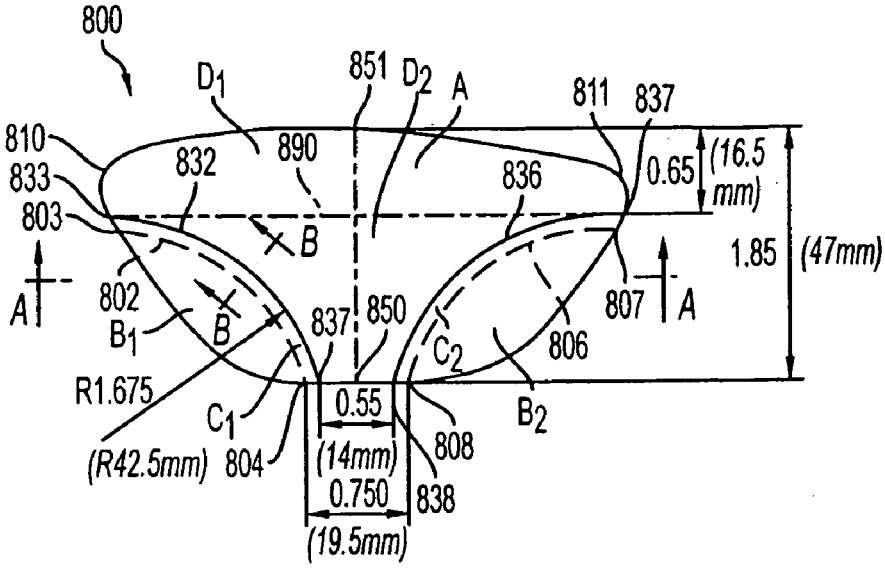
FIGS. 8A–C illustrate an embodiment of the golf club face.
Figure 8B:
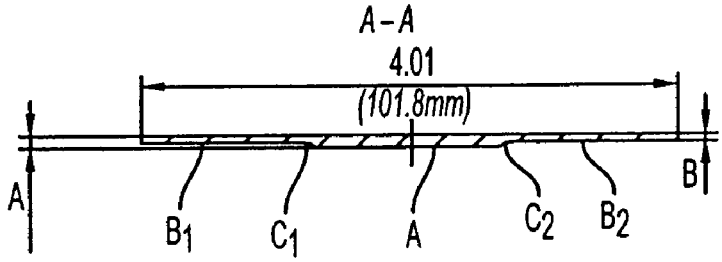
Figure 8C:
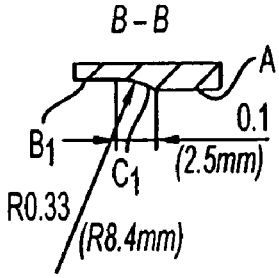

This alternative embodiment is illustrated in FIGS. 8A–8C. FIG. 8A illustrates a golf club face 800. As shown in FIG. 8A, golf club face 800 includes three non-overlapping regions: (1) region A; (2) region B1; and (3) region B2. Additionally, face 800 may include a region C1, which is positioned between regions A and B1, and a region C2, which is located between regions A and B2.

In the embodiment where face 800 includes region C1, region B1 is bounded by a portion of the edge of face 800 and a line 802, otherwise it is bounded by a line 832 and the portion of the edge of face 800. Line 802 extends from a first point 803 located at the edge of face 800 and below an upper left-hand corner 810 of face 800 to a second point 804 located at the edge of face 800 to the left of a bottom-center-edge point 850. In one embodiment, second point 804 is about 10 mm to the left of bottom-center-edge point 850, but other distances are contemplated. Preferably, line 802 is a curved line in the shape of a parabola, but the line may also be straight.

Similarly, in the embodiment where face 800 includes region C2, region B2 is bounded by a portion of the edge of face 800 and a line 806, otherwise it is bounded by a line 836 and the portion of the edge of face 800. Line 806 extends from a first point 807 located at the edge of face 800 below an upper right-hand corner 811 of face 800 to a second point 808 located at the edge of face 800 to the right of bottom-center-edge point 850. In one embodiment, second point 808 is about 10 mm to the right of bottom-center-edge point 850, but other distances are contemplated. Preferably, line 806 is a curved line in the shape of a parabola, but the line may also be straight.

Region A encompasses all or substantially all of the remaining portion of face 800. Conceptually, region A can be divided along a line 890 that extends from a point 833 to a point 837. Line 890 bisects region A into a top region D1 and a bottom-center region D2. As shown in FIG. 8A, top region D1 can have a width of about 16.5 mm and can extend lengthwise from the upper-right-hand corner 811 to the upper-left-hand corner 810. In other embodiments, the width of top region D1 can range between about one quarter and one half of the width of the face (e.g., between about 10 mm and 25 mm, in the embodiment shown in FIG. 8A).

A region C1 and a region C2 may be positioned between regions A and B1 and A and B2, respectively. In the embodiment shown in FIG. 8A, region C1 is bounded by line 802 and line 832, and region C2 is bounded by line 806 and line 836. Line 832 extends from a first point 833 located at the edge of face 800 and located between point 803 the upper left-hand corner 810 of face 800 to a second point 834 located at the edge of face 800 and located between point 804 and bottom-center-edge point 850. Line 836 extends from a first point 837 located at the edge of face 800 and located between point 807 the upper right-hand corner 811 of face 800 to a second point 838 located at the edge of face 800 and located between point 808 and bottom-center-edge point 850. Preferably, lines 832 and 836 are curved lines, each in the shape of a parabola, but the lines may also be straight.

As shown in FIG. 8A, both point 833 and point 837 have the same vertical distance from a top-center-edge point 851. In the embodiment shown, this vertical distance is about 16.5 mm. In alternative embodiments, it is contemplated that this vertical distance can be anywhere between about one quarter and one half of the width of the face, which, in the embodiment shown, is about 47 mm.

As discussed above with respect to other embodiments, regions D1, D2, B1, and B2 each may have a substantially uniform thickness. Preferably, regions D1 and D2 have the same thickness and regions B1 and B2 have the same thickness which is thinner than the thickness of regions D1 and D2. This feature is illustrated in FIG. 8B.

FIGS. 8B and 8C show that, unlike regions A and B, regions C1 and C2 do not have a substantially uniform thickness. That is, region C1 provides a gradual transition region between regions A and B1 so that face 800 does not have an abrupt change in thickness between regions A and B1. Likewise, region C2 provides a gradual transition region between regions A and B2. FIG. 8C also shows that region C1 has a preferred width of about 2.5 mm and a preferred radius of curvature of about 8.4 mm, but other widths and curvatures are contemplated.

While the above example embodiment includes a center portion 130 that has a substantially flat lower edge, alternate embodiments could include a rounded bottom edge or a pointed lower end. In addition, while the thickness of the lower toe portion 125 and lower heel portion 135 are the same in the above example embodiment, in an alternate embodiment they could be different with the lower heel portion 135 being thicker than the lower toe portion 125 or vice versa.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A method for making a wood-type golf club head, comprising:

forming a face portion of the golf club head from a piece of sheet metal consisting essentially of a titanium alloy, wherein the titanium alloy consists essentially of about 4.4 to 5.7 weight percent aluminum, about 4.0 to 5.5 weight percent molybdenum, about 4.0 to 5.5 weight percent vanadium, about 0.5 to 1.5 weight percent chromium and about 0.5 to 1.5 weight percent iron, with the remainder being substantially titanium; and after forming the face portion, attaching the formed face portion to a crown and a sole of the golf club head, wherein the step of forming the face portion comprises:

pressing the piece of sheet metal into a die at about 70 tons psi;

heat treating the piece of sheet metal to increase the hardness of the piece of sheet metal.

2. The method of claim 1, wherein, prior to pressing the piece of sheet metal, the sheet metal has a substantially uniform thickness of at least about 0.075 inches.

3. The method of claim 1, further comprising the step of casting the crown and sole as one seamless and joined piece to form a cast body.

4. The method of claim 1, wherein the face portion is attached to the crown and the sole by welding.

5. The method of claim 1, wherein the heat treatment raises the Rockwell Hardness to at least about 45.

6. The method of claim 1, further comprising the step of machining the piece of sheet metal.

7. The method of claim 1, wherein the face portion comprises an upper portion, a lower portion, a toe side edge, a heel side edge, and a bottom edge, said lower portion having a lower toe portion located towards a toe of the golf club head, a lower heel portion located towards a heel of the golf club head, and a center portion located between the lower toe portion and the lower heel portion, said lower toe portion and said lower heel portion each (a) being substantially oval in shape, (b) having a side that is generally parabolic in shape, and (c) having a first substantially uniform thickness, said center portion and said upper portion having a second substantially uniform thickness, said second thickness being greater than said first thickness.

8. The method of claim 7, wherein:

said parabolic side of the lower toe portion extends from a point substantially on the toe side edge of the face to a first point substantially on the bottom edge of the face;

said parabolic side of the lower heel portion extends from a point substantially on the heel side edge of the face to a second point substantially on the bottom edge;

said center portion has a heel side that coincides with the side of the lower heel portion that is generally parabolic in shape, a toe side that coincides with the side of the lower toe portion that is generally parabolic in shape, and an upper side that coincides with at least a portion of a lower side of the upper portion.

9. The method of claim 1, wherein the face consists of an upper portion and lower portion, wherein said lower portion consists of a lower toe portion located toward the toe of the golf club head, a lower heel portion located toward the heel of the golf club head, and a center portion located between the lower toe portion and the lower heel portion, said lower toe portion and said lower heel portion each having a substantially parabolic curved side and each having a substantially uniform thickness of at least about 0.055 inches, and said center portion and said upper portion each have a substantially uniform thickness of at least about 0.07 inches.

10. The method of claim 1, wherein the face portion comprises:

an upper portion, a lower portion, a first side edge, a second side edge, a top center edge, and a bottom center edge, wherein, said lower portion has a lower toe portion located towards the toe of the golf club head, a lower heel portion located towards the heel of the golf club head, and a center portion extending from the lower toe portion to the lower heel portion, wherein said upper portion extends from said top center edge a distance in a range of about one fourth to one half of the distance from said top center edge to said bottom center edge, said entire upper portion extends substantially the entire length of said face portion, said lower toe portion and said lower heel portion having a first substantially uniform thickness, said center portion and said upper portion have a second substantially uniform thickness, and said second substantially uniform thickness is greater than said first substantially uniform thickness.

11. The method of claim 10, wherein the first substantially uniform thickness is in a range of about 0.070 inches to 0.095 inches and the second substantially uniform thickness is in a range of about 0.055 inches to 0.065 inches.

12. A method for making a golf club head, comprising:

forming a variable thickness face portion of the golf club head from a piece of sheet metal having a substantially uniform thickness, the piece of sheet metal consisting essentially of a titanium alloy; and after forming the variable thickness face portion, attaching the formed face portion to a crown and a sole of the golf club head, wherein the step of forming the variable thickness face portion comprises:

cutting sheet metal to create the piece of sheet metal;

pressing the piece of sheet metal into a die at about 70 tons psi; and heat treating the piece of sheet metal to increase the hardness of the piece of sheet metal, wherein the face portion comprises an upper portion, a lower portion, a toe side edge, a heel side edge, and a bottom edge, said lower portion having a lower toe portion located towards a toe of the golf club head, a lower heel portion located towards a heel of the golf club head, and a center portion located between the lower toe portion and the lower heel portion, said lower toe portion and said lower heel portion each (a) being substantially oval in shape, (b) having a side that is generally parabolic in shape, and (c) having a first substantially uniform thickness, said center portion and said upper portion having a second substantially uniform thickness, said second thickness being greater than said first thickness.

13. The method of claim 12, wherein:

said parabolic side of the lower toe portion extends from a point substantially on the toe side edge of the face to a first point substantially on the bottom edge of the face;

said parabolic side of the lower heel portion extends from a point substantially on the heel side edge of the face to a second point substantially on the bottom edge;

said center portion has a heel side that coincides with the side of the lower heel portion that is generally parabolic in shape, a toe side that coincides with the side of the lower toe portion that is generally parabolic in shape, and an upper side that coincides with at least a portion of a lower side of the upper portion.

14. A method for making a golf club head, comprising:

forming a variable thickness face portion of the golf club head from a piece of sheet metal having a substantially uniform thickness, the piece of sheet metal consisting essentially of a titanium alloy; and after forming the variable thickness face portion, attaching the formed face portion to a crown and a sole of the golf club head, wherein the step of forming the variable thickness face portion comprises:

cutting sheet metal to create the piece of sheet metal;

pressing the piece of sheet metal into a die at about 70 tons psi; and heat treating the piece of sheet metal to increase the hardness of the piece of sheet metal, wherein the face consists of an upper portion and lower portion, wherein said lower portion consists of a lower toe portion located toward the toe of the golf club head, a lower heel portion located toward the heel of the golf club head, and a center portion located between the lower toe portion and the lower heel portion, said lower toe portion and said lower heel portion each having a substantially parabolic curved side and each having a substantially uniform thickness of about 0.055 inches, and said center portion and said upper portion each have a substantially uniform thickness of about 0.07 inches.

15. A method for making a golf club head, comprising:

forming a variable thickness face portion of the golf club head from a piece of sheet metal having a substantially uniform thickness, the piece of sheet metal consisting essentially of a titanium alloy; and after forming the variable thickness face portion, attaching the formed face portion to a crown and a sole of the golf club head, wherein the step of forming the variable thickness face portion comprises:

cutting sheet metal to create the piece of sheet metal;

pressing the piece of sheet metal into a die at about 70 tons psi; and heat treating the piece of sheet metal to increase the hardness of the piece of sheet metal, wherein the face portion comprises:

an upper portion, a lower portion, a first side edge, a second side edge, a top center edge, and a bottom center edge, wherein, said lower portion has a lower toe portion located towards the toe of the golf club head, a lower heel portion located towards the heel of the golf club head, and a center portion extending from the lower toe portion to the lower heel portion, wherein said upper portion extends from said top center edge a distance in a range of about one fourth to one half of the distance from said top center edge to said bottom center edge, said upper portion extends substantially the entire length of said face portion, said lower toe portion and said lower heel portion having a first substantially uniform thickness, said center portion and said upper portion have a second substantially uniform thickness, and said second substantially uniform thickness is greater than said first substantially uniform thickness.

16. The method of claim 15, wherein the second substantially uniform thickness is in a range of about 0.070 inches to 0.095 inches and the first substantially uniform thickness is in a range of about 0.055 inches to 0.065 inches.

17. A method for making a golf club head, comprising:

forming a face portion of the golf club head from a piece of sheet metal consisting essentially of a titanium alloy; and after forming the face portion, attaching the formed face portion to a crown and a sole of the golf club head, wherein the step of forming the face portion comprises:

cutting the sheet metal to create the face portion;

pressing the face portion into a die at about 70 tons psi;

heat treating the face portion to increase the hardness of the face portion, and wherein the face portion comprises:

an upper portion, a lower portion, a first side edge, a second side edge, a top center edge, and a bottom center edge, wherein, said lower portion has a lower toe portion located towards the toe of the golf club head, a lower heel portion located towards the heel of the golf club head, and a center portion extending from the lower toe portion to the lower heel portion, wherein said upper portion extends from said top center edge a distance in a range of about one fourth to one half of the distance from said top center edge to said bottom center edge, said upper portion extends substantially the entire length of said face portion, said lower toe portion and said lower heel portion having a first substantially uniform thickness, said center portion and said upper portion have a second substantially uniform thickness, and said second substantially uniform thickness is greater than said first substantially uniform thickness.

* * * * *